US005547528A

United States Patent [19]

Erickson et al.

[11] Patent Number: 5,547,528

[45] **Date of Patent: *Aug. 20, 1996**

[54] NON-TOXIC PRIMER

[75] Inventors: Jack A. Erickson, Andover; Robert L. Kramer, Minneapolis; John M. Hallis, Buffalo, all of Minn.

[73] Assignee: Federal-Hoffman, Inc., Anoke, Minn.

[ * ] Notice: The term of this patent shall not extend beyond the expiration date of Pat. No. 5,466,315.

[21] Appl. No.: 451,559

[22] Filed: May 26, 1995

[51] Int. Cl.[6] ..... C06B 25/34

[52] U.S. Cl. ..... 149/92; 149/22

[58] Field of Search ..... 149/92, 14, 22; 102/292, 471

[56] References Cited

U.S. PATENT DOCUMENTS

| | | | |
|---|---|---|---|
| 3,707,411 | 12/1972 | Gawlick et al. | 149/14 |
| 3,963,544 | 6/1976 | Staba | 149/23 |
| 4,608,102 | 8/1986 | Krampen et al. | 149/92 |
| 5,126,199 | 6/1993 | Bjerke et al. | 102/471 |
| 5,167,736 | 12/1992 | Mei et al. | 149/22 |
| 5,388,519 | 2/1995 | Guindon et al. | 102/292 |

*Primary Examiner*—Charles T. Jordan
*Assistant Examiner*—John R. Hardee
*Attorney, Agent, or Firm*—Schroeder & Siegfried, P.A.

[57] ABSTRACT

An improved non-toxic primer which is devoid of metallic oxidizing compounds and of hygroscopic compounds and is comprised of 30–75% by weight of at least two percussion-sensitive compounds selected from a group consisting of a diazo, a triazole, and a tetrazole compound mixed with approximately 10–30% by weight of a suitable propellant, and a frictionator comprised preferably of approximately 12% by weight of calcium silicide and 8% by weight of fine particles of glass. The glass preferably has a particle size of dimensions less than 0.0021". The primer provides improved propellant ignition, non-toxic ignition products, improved ballistic data, and greatly minimizes misfires.

25 Claims, No Drawings

NON-TOXIC PRIMER

BACKGROUND OF THE INVENTION

The invention described and claimed herein is an improvement of the non-toxic primer composition described and claimed in our co-pending and allowed patent application Ser. No. 08/301,347 filed by us on Sep. 6, 1994, and entitled "NON-TOXIC PRIMER FOR CENTER-FIRE CARTRIDGES."

As a consequence of the above, the Background of the Invention as set forth in said co-pending application is pertinent to our invention, as described and claimed herein, and therefore is incorporated herein by reference thereto. In addition, the known prior art as described in said Background of the invention is incorporated herein by reference thereto.

In said Background of the Invention, we described in considerable detail the testing program in which we have been engaged. Since filing said application, we have continued that testing program in an effort to further improve such a non-toxic primer. We have now developed an improved non-toxic primer which performs in an improved manner, especially with respect to malfunctioning. We have now developed a new and improved non-toxic primer which has substantially fewer misfires, and yet performs in all other respects substantially equally as well or better than the other known primers.

The need for a non-toxic primer, as described in the above co-pending application, still exists and, if anything, has increased. Our improvement, as described and claimed herein, also is devoid of metallic oxidizing compounds and of hygroscopic compounds, the need for which is outlined quite clearly in our above co-pending application for patent.

The closest prior art of which we have knowledge is U.S. Pat. No. 3,707,411 issued to Gowlick et al; U.S. Pat. No. 5,167,736 issued to Mei et al; and U.S. Pat. No. 5,216,199 issued to Bjerke et al. Additional pertinent patents are identified in the Background of the Invention section of our above co-pending application. None of these patents, to the best of our knowledge, teach the specific percentages of ingredients disclosed and claimed herein, and none of them disclose a truly non-toxic primer which is devoid of both metallic oxidizing compounds and of hygroscopic compounds.

BRIEF SUMMARY OF THE INVENTION

We have discovered a substantial improvement for the Non-Toxic Primer described and claimed in our above presently allowed patent application on a Non-Toxic Primer. In said application, we disclosed and claimed such a primer mix having a preferred composition of 45% by weight of DDNP (diazodinitrophenol), 10% by weight of tetracene, 25% by weight of Hercules Fines, and 20% by weight of calcium silicide. As indicated therein, we developed this formula after a great deal of testing, and found it provides improved ballistic data. We have continued our testing, however, and have now developed an additional improvement which substantially reduces the number of misfires as well as controlling the sensitivity of the mix.

We have found that by reducing the percentage of calcium silicide and substituting a limited amount of fine glass particles in lieu of the calcium silicide withheld, while maintaining the percentages of each of the other ingredients at their previously prescribed levels, as described in our earlier above patent application, we have developed an improved non-toxic primer which reduces the misfires to as low, in some cases, to four (4) in a million (1,000,000). In doing this, we have reduced the preferred percentage of calcium silicide to approximately 12% by weight, and have inserted approximately and preferably 8% of fine glass, in order to provide the improved performance.

We insure that the glass will be comprised of fine particles, by first passing it through a #270 U.S. sieve. Our tests show that such a primer mix provides improved performance, in excess of even that described in our above patent application, especially with respect to malfunctioning. We also find that the amount and size of the individual particles of glass controls the sensitivity of the mix, as well as improving the performance thereof.

It will be seen from the above that our invention utilizes two percussion-sensitive explosives in combination with a suitable propellant, calcium silicide, and a measure of finely divided glass particles. Thus, 30–75% by weight of the mix is made up of the two primary explosives, DDNP and tetracene. About 10–30% by weight is propellant and about 10–22% by weight of the mix is calcium silicide, and the balance is comprised of fine particles of glass, which amounts to about 3–15% by weight.

Our preferred mix is comprised of approximately 25% by weight of a suitable propellant, such as nitrocellulose and Hercules Fines, approximately 45% by weight of diazodinitrophenol, approximately 10% by weight of tetracene, approximately 12% by weight of calcium silicide, and approximately 8% of fine glass particles. Such a mix controls the sensitivity of the primer and, at the same time, greatly reduces and stabilizes the number of misfires.

From the above, it can be seen that our improved primer mix has new and definite attributes, in addition to the fact that it eliminates the use of metallic oxidizing compounds, which are toxic and hence undesirable, as well as hygroscopic oxidizers. It also eliminates the need for the use of reducing and oxidizing agents. In addition, it substantially diminishes or eliminates the deposition of toxic or heavy metals on firearms, as well as the distribution of such metals into the atmosphere. Thus, like the primer mix disclosed and claimed in our above earlier patent application, our improved non-toxic primer mix has both increased practical and environmental attributes.

DETAILED DESCRIPTION OF THE INVENTION

Our earliest efforts and test results are described in our above prior patent application. These accounts of such efforts are incorporated herein by reference thereto. Here, as decided and indicated therein, we utilize substantially the same proportions (10–30%) of a suitable propellant such as nitrocellulose alone, or Hercules Fines, which is a double-based propellant made up of nitrocellulose and nitroglycerine and is finely divided. Wherever hereinafter and in the claims the term "suitable propellant" is utilized, it is intended to connote either nitrocellulose or Hercules Fines. These propellants serve the same purposes as outlined in our above prior application.

we also utilize substantially the same proportions of the two primary explosives, DDNP and tetracene. Thus, approximately 30–75% by weight of the mix is comprised of these two explosives. As indicated in the claims, these two explosives are taken from a group consisting of a diazo, a triazole, and a tetrazole compound.

The balance of the mix has been changed. Thus, we have found that substantial improvements in the mix can be obtained by reducing the proportion of the calcium silicide to 10–22% by weight, and by adding, in lieu thereof, 3–15% by weight of fine particles of glass as a frictionator substitute for the calcium silicide which has been withheld. The particles of glass are preferably of relatively small size. We have discovered that, if we utilize only particles of glass which have passed through a U.S. #270 sieve, substantially improved results are obtained. Such particles, according to the catalog of Curtin Matheson Scientific, Incorporated, 7677 Equitable Drive, Eden Prairie, Minn., have openings of 0.0021". The small size of these particles serve to control and stabilize the sensitivity of the primer. Their presence serves to supplement the frictionating function of the reduced proportion of the calcium silicide.

The tetracene and diazonitrophenol (DDNP) provide the needed primary explosive function and the propellant such as Hercules Fines functions as a fuel. The calcium silicide functions as a fuel to send hot particles into the gun powder and as a frictionator, the latter function being supplemented by the fine particles of glass which functions as a friction point against which the explosive can be applied.

The proportions of the above ingredients which we prefer are as follows:

(a) approximately 25% by weight of a suitable propellant;

(b) approximately 45% by weight of DDNP;

(c) approximately 10% by weight of tetracene;

(d) approximately 12% by weight of calcium silicide; and (e) approximately 8% by weight of fine particles of glass.

We find in our tests that the number of misfires is substantially reduced, when using the above composition with some of the tests showing the number of misfires as low as four (4) in one million (1,000,000). In addition, the resultant mix has substantially greater stability and, hence, is less dangerous to utilize in ammunition.

We have also found that the more desirable range of the combined weights of the two primary explosives, when utilized with the preferred proportions of calcium silicide and fine glass particles, is 30–55% by weight. The preferred ranges of said percussion-sensitive compounds is 20–45% by weight of diazodinitrophenol and 10–30% by weight of tetracene. As indicated hereinbefore, these two primary explosives are selected from a group consisting of a diazo, a triazole, and a tetrazole compound.

As is common in the industry, we utilize a gum as a binder, in conjunction with each of the above mixes. While there may be other suitable gums, such as gum arabic, polyvinyl alcohol and gum karaya, we utilize tragacanth in amounts within the range of 0.8–2.0% by weight. We prefer to use this gum in proportions of 1.6% by weight.

We believe there are other suitable frictionators which may be utilized in lieu of calcium silicide. For example, it appears that such a group of suitable frictionators includes calcium silicide, aluminum oxide, ground coal, and boron. They should preferably be used in mixes having the same proportions and using the same particle size, as prescribed hereinbelow.

As indicated above, the newly prescribed proportions and ingredients in our primer mix provide definite advantages for, although the lack of hygroscopic compounds as an ingredient does diminish misfires, it does not provide the stability or diminish the number of misfires to the extent to which our above new primer composition accomplishes said purposes. Our new mix provides substantially all the advantages of the nontoxic primer described and claimed in our above allowed application for patent and, in addition, greatly reduces the number of misfires and more effectively controls the sensitivity of the mix.

It will, of course, be understood that various changes may be made in the form, details, arrangement and proportions of the parts without departing from the scope of the invention which comprises the matter shown and described herein and set forth in the appended claims.

We claim:

1. A non-toxic primer composition for use in small arms cartridges, which is devoid of metallic oxidizing compounds and of hygroscopic compounds comprising a mixture of:

(a) about 10–30% by weight of a suitable propellant;

(b) approximately 30–75% by weight of at least two percussion-sensitive compounds selected from a group consisting of a diazo, a triazole, and a tetrazole compounds;

(c) about 10–22% by weight of calcium silicide; and (d) approximately 3–15% by weight of particles fine of glass.

2. The composition defined in claim 1, wherein the percentage by weight of fine particles of glass approximates 8%.

3. The composition defined in claim 1, wherein the percentage by weight of calcium silicide approximates 12%.

4. The composition defined in claim 1, wherein the percentage by weight of particles of glass approximates 8% and the percentage by weight of calcium silicide approximates 12%.

5. The composition defined in claim 1, wherein the combined percentages by weight of calcium silicide and the particles of glass amount to about 20%.

6. The composition defined in claim 1, wherein one of the two percussion-sensitive compounds is diazodinitrophenol.

7. The composition defined in claim 1, wherein one of the two percussion-sensitive compounds is tetracene.

8. The composition defined in claim 1, wherein the two percussion-sensitive compounds are diazodinitrophenol and tetracene.

9. The composition defined in claim 1, wherein one of the two percussion-sensitive compounds consists of approximately 45% by weight of diazodinitrophenol.

10. The composition defined in claim 1, wherein one of the two percussion-sensitive compounds consists of approximately 10% by weight of tetracene.

11. The composition defined in claim 1, wherein the two percussion-sensitive compounds consist of approximately 45% by weight of diazodinitrophenol and approximately 10% by weight of tetracene.

12. The composition defined in claim 1, wherein said suitable propellant consists of Hercules Fines.

13. The composition defined in claim 1, wherein said particles of glass have dimensions less than 0.0021 inches.

14. The composition defined in claim 1, wherein said particles of glass are capable of passing through a U.S. #270 sieve.

15. The composition defined in claim 1, wherein said composition includes about 0.8–2.0% by weight of tragacanth.

16. The composition defined in claim 1, wherein said composition includes about 1.6% by weight of tragacanth.

17. A non-toxic primer composition which is devoid of metallic oxidizing compounds and of hygroscopic compounds, comprising a mixture of:

(a) approximately 25% by weight of a suitable propellant;

(b) approximately 45% by weight of diazodinitrophenol;

(c) approximately 10% by weight of tetracene;

(d) approximately 12% by weight of calcium silicide; and (e) approximately 8% by weight of small particles of glass.

18. A non-toxic primer composition for small arms cartridges which is devoid of metallic oxidizing compounds and of hygroscopic compounds, comprising a mixture of:

(a) about 10–30% by weight of a suitable propellant;

(b) approximately 30–55% by weight of at least two percussion-sensitive compounds selected from a group consisting of a diazo, a triazole and a tetrazole compound;

(c) approximately 12% by weight of calcium silicide; and (d) approximately 8% by weight of particles of glass.

19. The mixture defined in claim 18, wherein said two percussion-sensitive compounds consist of 20–45% by weight of diazodinitrophenol and 10–30% by weight of tetracene.

20. A non-toxic primer for small arms cartridges which is devoid of metallic oxidizing compounds and of hygroscopic compounds comprising a mixture of:

(a) about 10–30% by weight of a suitable propellant;

(b) approximately 30–75% by weight of at least two percussion-sensitive compounds selected from a group consisting of a diazo, a triazole, and a tetrazole compounds;

(c) a frictionator consisting of approximately 3–15% by weight of particles of glass; and (d) approximately 10–22% by weight of a suitable other frictionator.

21. The composition defined in claim 20, wherein said suitable other frictionator is boron.

22. The composition defined in claim 20, wherein said suitable other frictionator is approximately 12% by weight of calcium silicide.

23. The composition defined in claim 20, wherein said suitable other frictionator is aluminum oxide.

24. The composition defined in claim 20, wherein said suitable other frictionator is ground coal.

25. The composition defined in claim 20, wherein the suitable propellant is comprised of Hercules Fines.

* * * * *